United States Patent [19]

Nakahama et al.

[11] Patent Number: 4,931,027

[45] Date of Patent: Jun. 5, 1990

[54] TILTING DEVICE FOR OUTBOARD ENGINE

[75] Inventors: Ryoji Nakahama; Toshiyuki Yamazaki, both of Iwata, Japan

[73] Assignee: Sanshin Kogyo Kabushiki Kaisha, Hamamatsu

[21] Appl. No.: 672,410

[22] Filed: Nov. 16, 1984

[30] Foreign Application Priority Data

Nov. 25, 1983 [JP] Japan ..... 58-220808

[51] Int. Cl.[5] ..... B63H 5/12

[52] U.S. Cl. ..... 440/53; 440/63

[58] Field of Search ..... 440/53–56, 440/58–65, 49; 248/641, 642

[56] References Cited

U.S. PATENT DOCUMENTS

| | | | |
|---|---|---|---|
| 1,840,948 | 1/1932 | Harvey | 440/63 |
| 3,269,351 | 8/1966 | Shimanckas | 440/53 |
| 3,570,443 | 3/1971 | Dewhurst | 440/61 |
| 3,915,111 | 10/1975 | Buddrus | 440/61 |
| 3,990,660 | 11/1976 | Pipoz | 440/61 |
| 4,013,249 | 3/1977 | Meyer | 248/4 |
| 4,354,848 | 10/1982 | Hall | 440/61 |
| 4,355,986 | 10/1982 | Stevens | 440/53 |
| 4,403,969 | 9/1983 | Pichl | 440/61 |

FOREIGN PATENT DOCUMENTS 423942 3/1967 Japan ..... 440/53

OTHER PUBLICATIONS

Sales Literature by Minn Kota entitled "1980 MAG ELECTRIC FISHING MOTORS".

*Primary Examiner*—Joseph F. Peters, Jr.
*Assistant Examiner*—Clifford T. Bartz
*Attorney, Agent, or Firm*—Ernest A. Beutler

[57] ABSTRACT

A mounting arrangement for a marine drive including a pair of non-parallel unequal links pivotally connected at one of their ends to the transom and at their other ends to the outboard drive so that the outboard drive will be raised on pivotal movement of the links while maintaining a relatively lower amount of pivotal movement of the outboard drive relative to the associated watercraft so as to minimize the overhang and yet permit a large degree of raising of the propeller during the pivotal movement. The linkage system further permits the outboard drive to assume the desired trim angle under all driving conditions.

36 Claims, 1 Drawing Sheet

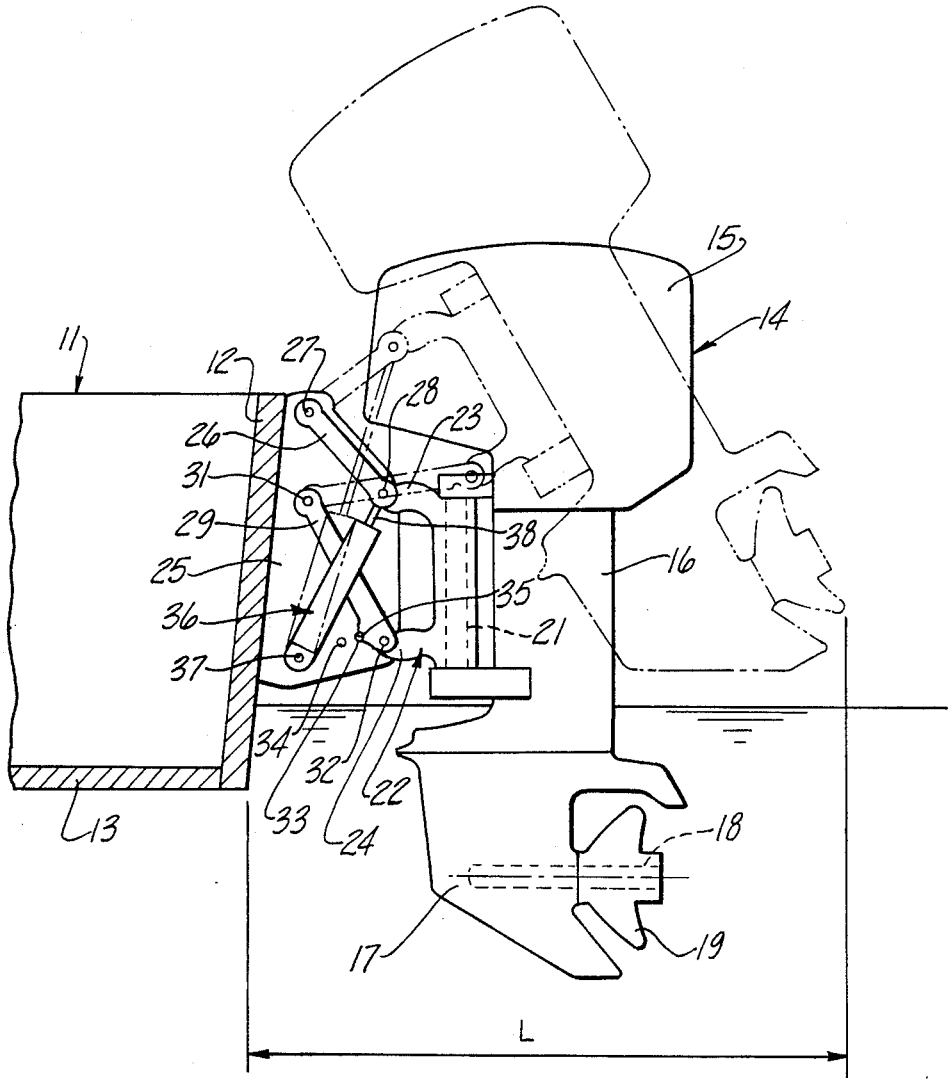
11
12
13
14
15
16
17
18
19
21
22
23
24
25
26
27
28
29
31
32
33
34
35
36
37
38
L

TILTING DEVICE FOR OUTBOARD ENGINE

BACKGROUND OF THE INVENTION

This invention relates to an improved tilting device for outboard engines and more particularly to an improved arrangement for suspending an outboard drive from the transom of an associated watercraft.

As is well known, a marine outboard drive, such as an outboard motor, is normally suspended from the transom of the associated watercraft for movement between a tilted down running position and a tilted up out of the water position. In addition, the supporting arrangements also permit trim adjustment of the angle of the propeller in the tilted down position. In one of the more common arrangements for supporting outboard drives for such movement, the outboard drive is supported for its pivotal movement about a single pivot axis. In this way, the propeller and propeller shaft swing through an arc when the trim and tilt angle of the motor or outboard drive is adjusted. Although such arrangements have the advantage of simplicity, they present several problems.

A problem in connection with such simple single pivot suspension arrangements for outboard drives is that the propeller extends a substantial distance rearwardly of the transom when the drive is in a tilted up arrangement. This causes the watercraft to take a much longer than normal effective length and makes maneuvering when docking and in similar circumstances very difficult. In addition, the center of gravity of the watercraft may be shifted rearwardly to such an extent as to cause the front of the hull to raise undesirably during such maneuvering. Another disadvantage with this type of arrangement, which is particularly prevalent in connection with outboard motors, is that the power unit itself is swung forwardly and encroaches over the transom into the interior area of the watercraft.

It is also known that it is desirable when accelerating to have the angle of the propeller shaft disposed at a negative degree to the horizontal and with the propeller positioned substantially below the keel line for good acceleration. However, when running at high speed, it is desirable that the propeller be substantially in line with the keel line and the angle of the propeller shaft should be in the range of 4° to 10° to the horizontal. The conventional single pivot axis support for outboard drives has not permitted adjustment of the drive through these preferred angle relationships.

Various linkage arrangements and suspension systems have been proposed that attempt to solve the aforenoted problems. However, of the previously proposed types of supporting arrangements, although they may solve some of the problems, they magnify others. For example, it has been proposed to provide a parallelogram linkage system for supporting the outboard drive for its movement. Such arrangements have the advantage of raising the drive more than a conventional single pivot axis arrangement, however, these systems tend to nevertheless cause the outboard drive to extend to too great a length during tilting up operation. In addition, it is also desirable to permit the outboard drive to pop up when an underwater obstacle is struck and some of the linkage systems previously proposed would not permit this movement.

It is, therefore, a principal object of this invention to provide an improved suspension arrangement for an outboard drive.

It is another object of this invention to provide a suspension arrangement for an outboard drive that will orient the propeller at the desired trim angles through its adjustment range.

It is a yet further object of this invention to provide a suspension arrangement for an outboard drive that is effective to cause the propeller to raise significantly in relation to its lengthwise extension during tilting up operation.

It is a still further object of the invention to provide an improved suspension and tilting arrangement for an outboard drive that is compact and which will permit the desired degrees of movement without encroaching in the area within the watercraft or unduly lengthening the effective length of the watercraft during tilting up operation.

SUMMARY OF THE INVENTION

A first feature of this invention is adapted to be embodied in a mounting arrangement for an outboard drive comprising a drive shaft housing and a lower unit supporting and driving a propeller shaft carrying a propeller. Linkage means are adapted to be affixed to an associated watercraft and means connect the linkage means to the outboard drive for movement of the outboard drive relative to the associated watercraft from a tilted down drive position through a plurality of trim positions to a tilted up out of the water position.

In accordance with one feature of the invention, the linkage means is effective to cause the propeller shaft to be raised upon movement from the drive position to the out of water position and to be rotated through an angle less than the angle necessary to raise the propeller shaft through the same height if the outboard drive was pivoted relative to the associated watercraft about a fixed pivot axis.

In accordance with another feature of the invention, the linkage means is effective to cause the propeller shaft to move from a trim in angle of about −4° to the horizontal when the outboard drive is in its fully tilted down position and wherein the propeller is positioned below the keel line of the associated watercraft to an angle in the range of about 4° to 10° to the horizontal when the outboard drive is tilted up to bring the propeller approximately in line with the keel line.

In accordance with yet another feature of the invention, the linkage means comprises a pair of links having unequal lengths and in non-parallel relationship that are pivotally connected at one of their ends to the outboard drive and at the other of their ends to the associated watercraft. In accordance with this feature of the invention, the links are disposed in a generally vertical direction when the outboard drive is in its tilted down, drive position.

BRIEF DESCRIPTION OF THE DRAWING

The single figure of the drawing is a side elevational view showing an outboard motor suspended from the transom of an associated watercraft, shown partially and in section, by a means constructed in accordance with an embodiment of the invention. The solid line view shows a tilted down position while the phantom line view shows a tilted up condition.

DETAILED DESCRIPTION OF THE PREFERRED EMBODIMENTS

In the drawing, a watercraft is shown partially in cross-section and is identified generally by the reference numeral 11. The watercraft 11 has a transom 12 and a keel 13. The exact details of construction of the watercraft 11 have not been illustrated nor will they be described since the invention has utility with any of a wide variety of watercraft.

An outboard motor, indicated generally by the reference numeral 14 is adapted to be attached to the transom 12, in a manner to be described. The outboard motor 14 includes a power head 15 that contains a driving internal combustion engine of any suitable type in a surrounding protective cowling. A drive shaft housing 16 depends from the power head 15 and contains a drive shaft (not shown) that is driven by the engine of the power head 15 in a known manner. A lower unit 17 depends from the drive shaft housing 16 and may contain a forward, neutral, reverse transmission (not shown) of any known type that, in turn, drives a propeller shaft 18 to which a propeller 19 is affixed.

A steering shaft 21 is fixed to the drive shaft housing 16 in a known manner and is, in turn, journaled for steering movement about a generally vertically extending axis within a swivel bracket 22. This affords a means whereby the motor 14 may be steered, as is well known in this art. The swivel bracket 22 has a upper, forwardly extending arm 23 and a lower forwardly extending arm 24 that are connected, by means of a linkage system, to a clamping bracket 25 that is affixed in a known manner to the transom 12 of the watercraft 11.

The linkage system includes a pair of upper links 26 that are pivotally connected at their forward, upper ends to the clamping bracket 25 by means of a pivot pin 27. The rearward, lower ends of the links 26 are pivotally connected to the swivel bracket arm 23 by means of a pivot pin 28.

In a similar manner, a pair of lower links 29 are pivotally connected at their forward, upper ends, to the clamping bracket 25 by means of a pivot pin 31. The rearward, lower ends of the links 29 are pivotally connected to the clamping bracket arm 24 by means of a pivot pin 32. The links 29 are longer than and non-parallel to the links 26, for a reason to become apparent.

As will be described, the linkage system comprising the links 26 and 29 permits the outboard motor 14 to be pivoted and swung relative to the transom 12 through a plurality of drive trim adjusted positions and a tilted up out of the water position. The trim adjusted positions are set by means of a trim pin 33 that is received within selected apertures 34 formed in the clamping bracket 25 and which are engaged within a notch or recess 35 formed in the links 29 so as to limit the downward movement of the motor 14.

The linkage system is constructed and oriented in such a way that the outboard motor 14 may pop up when an underwater obstacle is struck. A hydraulic arrangement, indicated generally by the reference numeral 36 is provided to control this popping up action. The hydraulic assembly 36 is of the piston cylinder type and may also be supplied with fluid under pressure so as to effect hydraulic adjustment of the trim and tilt position of the motor 14. Any of the known type of hydraulic devices may be utilized for this purpose. The assembly 36 has a cylinder with a lower portion that is pivotally connected by means of a pivot pin 37 to the clamping bracket 25. A piston is supported within the cylinder and is connected to a piston rod 38 which is, in turn, pivotally connected to the pivot pin so as to control the movement of the motor 14 relative to the transom 12 in a known manner.

In an embodiment of the invention, the links 26 and 29 are disposed so that they will extend in a generally vertical direction when the motor 14 is in its fully tilted down position. This is the condition when the trim pin 33 is in the lowermost series of apertures 34. At this time, the axis of the propeller shaft 18 will be disposed at a $-4°$ angle to the horizontal so that the propeller 19 will exert a partially upward thrust on the associated watercraft. At this time, the propeller 19 is also disposed substantially below the keel 13 so as to exert good thrust for accelertion. However, when the motor is positioned in its uppermost trimmed position, the axis of the propeller shaft 18 assumes a positive 10° angle with respect to the horizontal and the center line will lie approximately on the same plane as the lower end of the keel 13 so as to exert the maximum driving force.

The lengths of the links 26 and 29 and their angular relationship is such that, with an embodiment, the motor and specifically its drive shaft will swing through an angle of only about 36° between the fully lowered position and the tilted up out of the water position as shown in the phantom line view in the figure. During such movement, the center line of the propeller 19 will raise a distance of about 645 milliliters. At this time, the maximum rearward distance L of the propeller will be only 1050 millimeters. The lower links 29 will swing through an angle of 79° during such movement while the upper links swing through an angle of about 82° at the same time.

In another embodiment of the invention, the links 26 and 29 are disposed so that the propeller will be raised 670 millimeters and in its raised position the distance L is 1350 millimeters. With such a system, the angles of the propeller shaft 18 during the movement from the trim down to the trim up position will be about the same ($-4°$ to about $+8°$) and the drive shaft of the motor 14 will swing through an arc of 26° from the fully tilted down position to the tilted up out of the water position. With such an embodiment, the lower links 29 swing through an arc of 74° while the upper links 26 swing through an arc of 95°.

The two embodiments given are typical of the conditions which may result with a linkage system of the type illustrated. Various modifications and changes within these embodiments may be made, without departing from the spirit and scope of the invention, as defined by the appended claims.

We claim:

1. A mounting arrangement for an outboard drive comprising a drive shaft and a lower unit supporting and driving a propeller shaft carrying a propeller, linkage means adapted to be affixed to an associated watercraft, means connecting said linkage means to said outboard drive for movement of said outboard drive relative to the associated watercraft from a tilted down, driving position through a plurality of trim positions to a tilted up out of the water position, said linkage means being effective to cause said propeller shaft to be raised upon movement from the drive position to the out of the water position and rotated through an angle less than the angle necessary to raise said propeller shaft the same height if said outboard drive were pivoted relative to the watercraft about a fixed pivot axis, said linkage means defining an instant center through said movement positioned close to the upper forward edge of the outboard drive.

2. A mounting arrangement as set forth in claim 1 wherein the linkage means comprises a pair of non-parallel links pivotally connected at one of their ends to the outboard drive and adapted to be pivotally connected at their other ends to the associated watercraft.

3. A mounting arrangement as set forth in claim 1 wherein the linkage means comprises a pair of unequal length links pivotally connected at one of their ends to the outboard drive and adapted to be pivotally connected at the other of their ends to the associated watercraft.

4. A mounting arrangement as set forth in claim 3 wherein the links are disposed in a generally vertical direction when the outboard drive is in its tilted down driving position.

5. A mounting arrangement as set forth in claim 3 wherein the links are non-parallel.

6. A mounting arrangement as set forth in claim 5 wherein the lowermost link is longer than the uppermost link.

7. A mounting arrangement as set forth in claim 1 further including hydraulic motor means interposed between the drive shaft housing and the associated watercraft for controlling the position of the drive shaft housing relative to the associated watercraft.

8. A mounting arrangement as set forth in claim 7 wherein the hydraulic motor means comprises a linear acting hydraulic cylinder and piston assembly.

9. A mounting arrangement as set forth in claim 8 wherein the line of action of the motor piston assembly extends in a generally vertical direction when the outboard drive is in its drive position.

10. A mounting arrangement as set forth in claim 9 wherein the linkage means comprises a pair of non-parallel links pivotally connected at one of their ends to the outboard drive and adapted to be pivotally connected at their other ends to the associated watercraft.

11. A mounting arrangement as set forth in claim 9 wherein the linkage means comprises a pair of unequal length links pivotally connected at one of their ends to the outboard drive and adapted to be pivotally connected at the other of their ends to be associated watercraft.

12. A mounting arrangement as set forth in claim 11 wherein the links are disposed in a generally vertical direction when the outboard drive is in its tilted down driving position.

13. A mounting arrangement as set forth in claim 12 wherein the links are non-parallel.

14. A mounting arrangement for an outboard drive comprising a drive shaft housing and lower unit supporting and driving a propeller shaft carrying a propeller, linkage means adapted to be affixed to an associated watercraft, means connecting said linkage means to said outboard drive for movement of said outboard drive relative to the associated watercraft from a tilted down, driving position through a plurality of trim positions to a tilted up out of the water position, said linkage means being effective to cause said propeller shaft to move through an angle from about −4° to the horizontal when the outboard drive is tilted down fully and wherein the propeller is below the keel line of the associated watercraft to an angle in the range of about 4° to 10° to the horizontal when the outboard drive is tilted up to bring the propeller approximately in line with the keel line.

15. A mounting arrangement as set forth in claim 14 wherein the linkage means comprises a pair of non-parallel links pivotally connected at one of their ends to the outboard drive and adapted to be pivotally connected at their other ends to the associated watercraft.

16. A mounting arrangement as set forth in claim 14 wherein the linkage means defines an instant center positioned close to the upper forward edge of the outboard drive.

17. A mounting arrangement as set forth in claim 16 wherein the linkage means comprises a pair of non-parallel links pivotally connected at one of their ends to the outboard drive and adapted to be pivotally connected at their other ends to the associated watercraft.

18. A mounting arrangement as set forth in claim 16 wherein the linkage means comprises a pair of unequal lengths links pivotally connected at one of their ends to the outboard drive and adapted to be pivotally connected at the other of their ends to the associated watercraft.

19. A mounting arrangement as set forth in claim 18 wherein the links are disposed in a generally vertical direction when the outboard drive is in its tilted down driving position.

20. A mounting arrangement as set forth in claim 18 wherein the links are non-parallel.

21. A mounting arrangement as set forth in claim 20 wherein the lowermost link is longer than the uppermost link.

22. A mounting arrangement as set forth in claim 14 further including hydraulic motor means interposed between the drive shaft housing and the associated watercraft for controlling the position of the drive shaft housing relative to the associated watercraft.

23. A mounting arrangement as set forth in claim 22 wherein the hydraulic motor means comprises a linear acting hydraulic cylinder and piston assembly.

24. A mounting arrangement as set forth in claim 23 wherein the line of action of the motor piston assembly extends in a generally vertical direction when the outboard drive is in its drive position.

25. A mounting arrangement as set forth in claim 24 wherein the linkage means comprises a pair of non-parallel links pivotally connected at one of their ends to the outboard drive and adapted to be pivotally connected at their other ends to the associated watercraft.

26. A mounting arrangement as set forth in claim 24 wherein the linkage means comprises a pair of unequal length links pivotally connected at one of their ends to the outboard drive and adapted to be pivotally connected at the other of their ends to the associated watercraft.

27. A mounting arrangement as set forth in claim 26 wherein the links are disposed in a generally vertical direction when the outboard drive is in its tilted down driving position.

28. A mounting arrangement as set forth in claim 26 wherein the links are non-parallel.

29. A mounting arrangement as set forth in claim 28 wherein the lowermost link is longer than the uppermost link.

30. A mounting arrangement as set forth in claim 14 wherein the linkage means comprise a pair of unequal length links pivotally connected at one of their ends to the outboard drive and adapted to be pivotally connected at the other of their ends to the associated watercraft.

31. A mounting arrangement as set forth in claim 30 wherein the links are disposed in a generally vertical direction when the outboard drive is in its tilted down driving position.

32. A mounting arrangement as set forth in claim 30 wherein the links are non-parallel.

33. A mounting arrangement as set forth in claim 32 wherein the lowermost link is longer than the uppermost link.

34. A mounting arrangement for an outboard drive comprising a drive shaft housing and a lower unit supporting and driving a propeller shaft carrying a propeller, linkage means adapted to be affixed to an associated watercraft, means connecting said linkage means to said outboard drive for movement of said outboard drive for movement of said outboard drive relative to the associated watercraft from a tilted down, driving position through a plurality of trim positions to a tilted up out of the water position, said linkage means being effective to cause said propeller shaft to be raised upon movement from the drive position to the out of the water position and rotated through an angle less than the angle necessary to raise said propeller shaft the same height if said outboard drive were pivoted relative to the watercraft about a fixed pivot axis, said linkage means comprising a pair of unequal length links pivotally connected at one of their ends to said outboard drive and adapted to be pivotally connected at the other of their ends to the associated watercraft, said links being to make an angle less than 45 with a vertical plane passing through their upper pivot points when said outboard drive is in its tilted down driving position.

35. A mounting arrangement as set forth in claim 34 wherein the links are non-parallel.

36. A mounting arrangement as set forth in claim 35 wherein the lowermost link is longer than the uppermost link.

* * * * *